United States Patent [19]

Creighton

[11] 4,286,365

[45] Sep. 1, 1981

[54] HEAT EXCHANGERS

[75] Inventor: Gordon R. Creighton, Cambridge, England

[73] Assignee: Ciba-Geigy Corporation, Ardsley, N.Y.

[21] Appl. No.: 709,831

[22] Filed: Jul. 29, 1976

Related U.S. Application Data

[63] Continuation of Ser. No. 553,868, Feb. 27, 1975, abandoned.

[30] Foreign Application Priority Data

Mar. 14, 1974 [GB] United Kingdom ..... 11312/74

[51] Int. Cl.[3] ..... B23P 15/26

[52] U.S. Cl. ..... 29/157.3 V; 165/170

[58] Field of Search ..... 165/170; 29/157.3 V

[56] References Cited

U.S. PATENT DOCUMENTS

| | | | |
|---|---|---|---|
| 2,850,793 | 9/1958 | Schweller et al. | 29/157.3 V |
| 2,998,639 | 9/1961 | Forst et al. | 165/170 X |
| 3,763,681 | 5/1972 | Flintoft | 29/157.3 V |
| 3,831,246 | 8/1974 | Morris | 29/157.3 V |

*Primary Examiner*—Samuel Scott
*Assistant Examiner*—Theophil W. Streule, Jr.
*Attorney, Agent, or Firm*—Harry Falber

[57] ABSTRACT

A method of making a heat exchanger consisting of a conduit having a plurality of passes joined by integral return bends which comprises (i) bending two strips of material together in a zigzag manner to form a stack of substantially parallel passes, the two strips being displaced laterally with respect to one another, (ii) bonding the two strips together along lines substantially parallel to their longitudinal edges to form a flat, serpentine conduit, and (iii) inflating the conduit by applying internally a fluid under pressure.

15 Claims, 8 Drawing Figures

HEAT EXCHANGERS

Figure 1A:
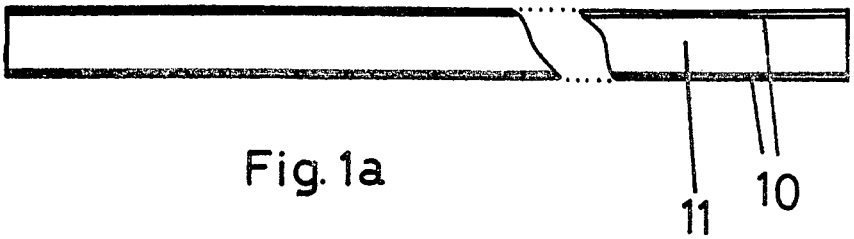

This is a continuation of application Ser. No. 553,868 filed on Feb. 27, 1975, now abandoned.

This invention relates to a new method for the manufacture of heat exchangers and to heat exchangers made by the new method.

Heat exchangers comprising top and bottom tanks connected by a series of metal tubes through which a heating or cooling fluid passes are well known. Such heat exchangers are expensive to manufacture because they comprise a number of shaped tubes, each of which must be fitted into holes in the top and bottom tanks and sealed into place. It is also known, in the manufacture of these heat exchangers, to form the tubes by applying adhesive to thin, appropriately shaped metallic pieces and abutting the pieces together with pressure to effect bonding. This process requires careful control, since unless the manufacture of the pieces is carried out to within very close tolerances, uneven pressing will occur which can cause misalignment and even imperfect seals.

It is further known, from British Patent Specification Nos. 770,296 and 1,167,090, to manufacture heat exchangers from thin metallic strips by a process in which the edges of the strips are bonded together along their length, the pairs of strips are bent into a serpentine configuration, and they are inflated by means of a fluid pressure internally applied. Such a method suffers from at least one serious drawback. In order to ensure that an open passage is obtained at the bends, uninflated joined pairs of strips are bent around curved formers, but the resultant stack cannot then be compressed. The uninflated stack is therefore comparatively bulky, and its storage and transportation is less of a practical proposition.

There has now been discovered a method by which these difficulties may be at least substantially overcome, in which the strips have integral return bends in the uninflated condition: in this state they may be stored and transported and then inflated when required. In this new method two strips of material are folded together in a serpentine configuration to form a stack in which one strip is displaced laterally with respect to the other. The strips are then bonded together longitudinally, usually under pressure and, when desired, they are inflated by ingress of a fluid (such as air or water) under pressure to form a heat exchanger matrix in which, by means of the integral return bends, it is ensured that an open passage is obtained at these bends without the need to take special precautions.

In accordance with the present invention, therefore, there is provided a method of making a heat exchanger consisting of a conduit having a plurality of passes joined by integral return bends which comprises (i) bending two strips of material together in a zigzag manner to form a stack of substantially parallel passes, the two strips being displaced laterally with respect to one another, (ii) bonding the two strips together along lines substantially parallel to their longitudinal edges to form a flat, serpentine conduit, and (iii) inflating the conduit by applying internally a fluid under pressure.

Usually, but not necessarily, the passes in the inflated conduit are parallel; other configurations, such as curved or sinusoidal passes, may also be adopted.

Materials used to make the new heat exchanger must be inert to attack by the heat exchange medium and to the fluid used in the inflation, and also sufficiently pliable, with heating if required, to deform and inflate when subjected to the internal pressure. Suitable materials may be metallic or non-metallic and include copper, mild steel, aluminium, aluminium alloy, and the following thermoplastic resins: poly(phenylene oxides), poly(phenylene sulphides), polysulphones, polyimides, and phenoxy resins. Metal strips, especially of aluminium or aluminium alloy, are preferred. Preferably, too, the strips are from 0.01 mm to 0.8 mm, and especially from 0.05 to 0.25 mm, thick, so as to be readily deformable on inflation.

Lateral displacement of one strip relative to the other may be effected by any suitable method. Two strips may, for example, be folded together and then pulled apart in the direction at right angles to the height of the stack. Or they may be folded separately to the same dimensions and fitted together so that the folds almost coincide. Another method is to fold the two strips together in the required displaced configuration.

The longitudinal edges of the strips may be bonded together either by means of a suitable adhesive, particularly a thermosetting resin adhesive composition, or, when they are metallic, by welding, soldering, or brazing. In any case the strips must be joined continuously in a pattern substantially parallel to the longitudinal edges of the strips, leaving one or more unbonded areas which are to be inflated. When an adhesive is used this is, of course, applied only to those parts which it is desired should be bonded together. When the strips are bonded by welding, soldering, or brazing, a release agent or stop-weld is usually applied to those areas which will be inflated to form the channels in the conduit.

As already indicated, any adhesive used must be resistant to the conditions under which the heat exchanger will be employed. For example, if the heat exchanger is to be used as a radiator in a water-cooled internal combustion engine of a motor vehicle, the adhesive must be resistant to hot water containing ethylene glycol or other anti-freeze component. The adhesive may be thermosetting, elastomeric, or thermoplastic, thermosetting adhesives being, as already indicated, preferred. It is an advantage of the method now provided that adhesives may be employed which require application of a heavy pressure to cause them to flow and adhere effectively: such adhesives could not be used in previously known methods for making heat exchangers where there was a risk of causing distortion of the bends. Typical suitable thermosetting adhesives are epoxide resins and phenolic resins, including phenolic resins containing an elastomer (such as nitrile rubber) or a thermoplast (such as nylon or a vinyl polymer). Suitable elastomeric adhesives are natural or synthetic rubbers such as chlorinated rubbers, nitrile rubbers, and polysulphide rubbers. Suitable thermoplastic adhesives include poly(vinyl acetate), poly(vinyl chloride), polyacrylates, and polyamides.

The adhesive or release agent is usually applied before the strips are folded into a stack. In forming the conduit, pressure is usually applied to the stack to assist bonding. Heat may also be applied at the same time, to cure a thermosettable resin employed as the adhesive or to weld, solder, or braze the edges of the strips together. It is sometimes advantageous, before applying pressure, to insert packing pieces between each pair of passes in the area of the return bends, each packing piece being substantially twice the thickness of the strips: in the area of the bends there is only half the total thickness of material that there is in the centre of the stack, and by inserting the packing pieces the thicknesses are equalised and the pressure is thereby made even throughout, thus ensuring better adhesion. Conveniently, the packing pieces are taken from material of the same thickness as that constituting the strips and bent double before insertion. After the stack has been compressed and bonding has taken place, these packing pieces may be removed.

In their simplest form, the heat exchangers are made from two strips of material bonded together only along their longitudinal edges. However, more complex heat exchangers can be made by having a series of lines of bonding in patterns parallel to the longitudinal edges. These lines of bonding may divide the conduit into at least two separate channels, or if desired, at least two interconnecting channels may be made by having inner discontinuous lines of bonding on the strips. These channels need not be straight but may take a circuitous path within each pass of the conduit.

It is also within the scope of the present invention to cut a stack of conduit into any required length or, where the stack comprises a series of channels, into a number of narrower conduits and, if necessary, to inflate these separately. In this way a manufacturer is enabled to make a heat exchanger of practically any smaller, required size from a standard stack of bonded material.

Inflating the conduit by means of gaseous or liquid fluid pressure is preferably carried out after shaped tool pieces have been inserted between layers of conduit and the stack has been constrained within a frame and has been fitted between tie bars.

Before or after inflation, finning pieces are preferably inserted between passes of conduit to increase the surface area of the heat exchanger. Such pieces are usually made of the same material as the conduit and may be fixed in position as by an adhesive. However, when the finning pieces are inserted before inflation of the stack, it is usually unnecessary to bond them in place; expansion of the passes of the heat exchanger usually provides sufficient grip to hold the finning pieces in place.

Completed heat exchangers may if desired, be provided with a coating to protect them against corrosion due to the atmosphere or other external influences as well as to serve as an adhesive for finning pieces. Such coatings are conveniently applied by dipping into an organic coating medium which may contain metallic particles.

The process of this invention is illustrated by way of Example in the accompanying drawings.

FIGS. 1*a* to 1*d* show plan views of strips treated with adhesive or release agent prior to being folded to form a stack. Where an adhesive is used the symbol 10 denotes that adhesive and 11 denotes untreated material, while where welding is employed 10 denotes untreated metal and 11 denotes metal treated with a release agent.

Figure 1B:
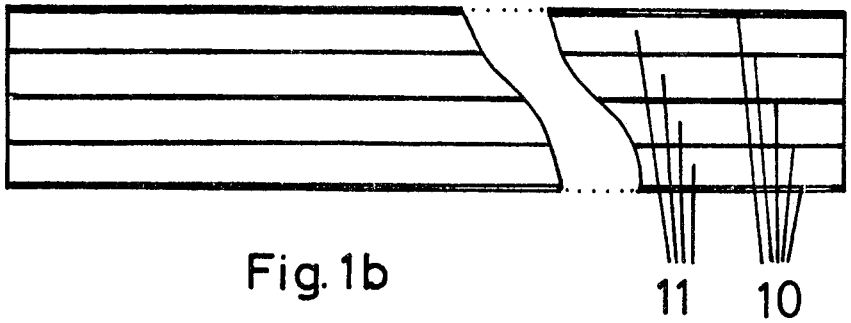
Figure 1C:
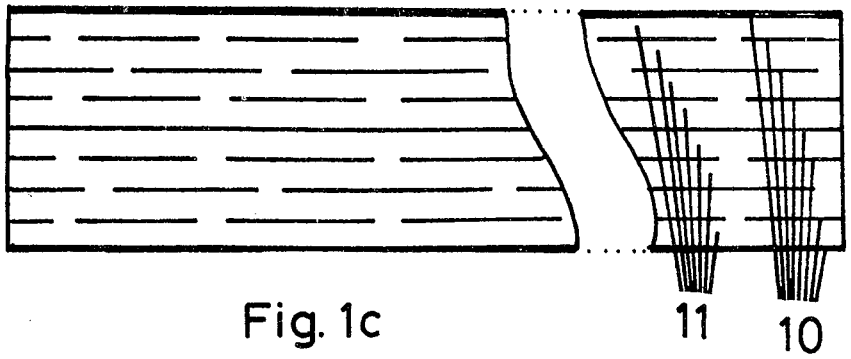
Figure 1D:
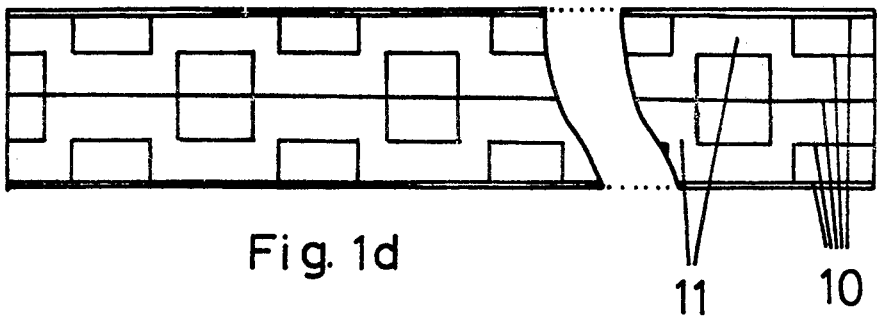

FIG. 1*a* shows a strip which is used to make a single channel heat exchanger while FIG. 1*b* shows a strip prepared for use in a multichannel heat exchanger. FIG. 1*c* shows a strip prepared for use in a multichannel heat exchanger in which some of the channels are interconnected. FIG. 1*d* shows a strip prepared for use in a multichannel heat exchanger in which the fluid used for heating or cooling takes a circuitous path along each pass.

Figure 2:
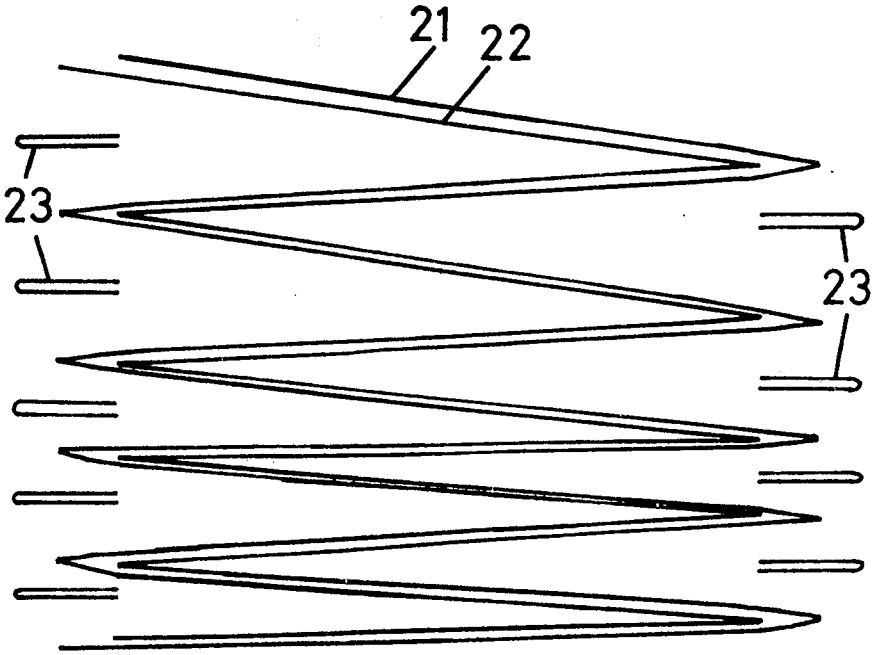

FIG. 2 shows a cross section through a folded, but not compressed, stack. Two metal strips 21 and 22, bearing lines of adhesive or release agent, are folded together with one strip laterally displaced with respect to the other. Before compression, packing pieces 23 which have a thickness twice that of each strip are inserted between each pass of the strips in the area around each bend.

Figure 3:
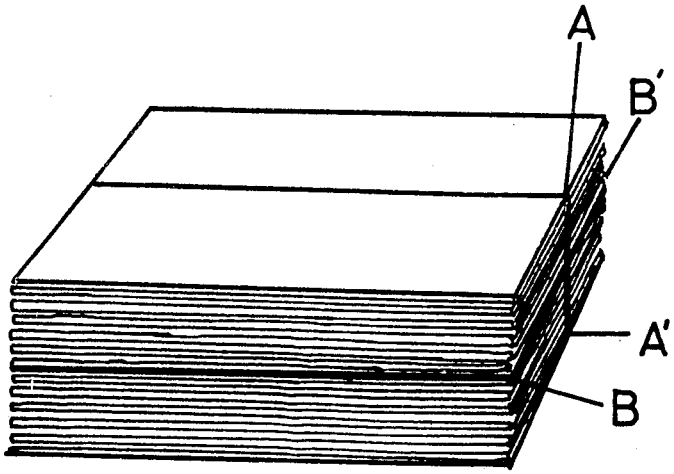

FIG. 3 shows a perspective view of an uninflated compressed stack. Prior to inflation this stack may be cut to reduce the number of channels in each pass, such as along a line AA′, and may be cut, e.g. along a line BB′, to reduce the height of the heat exchanger.

Figure 4:
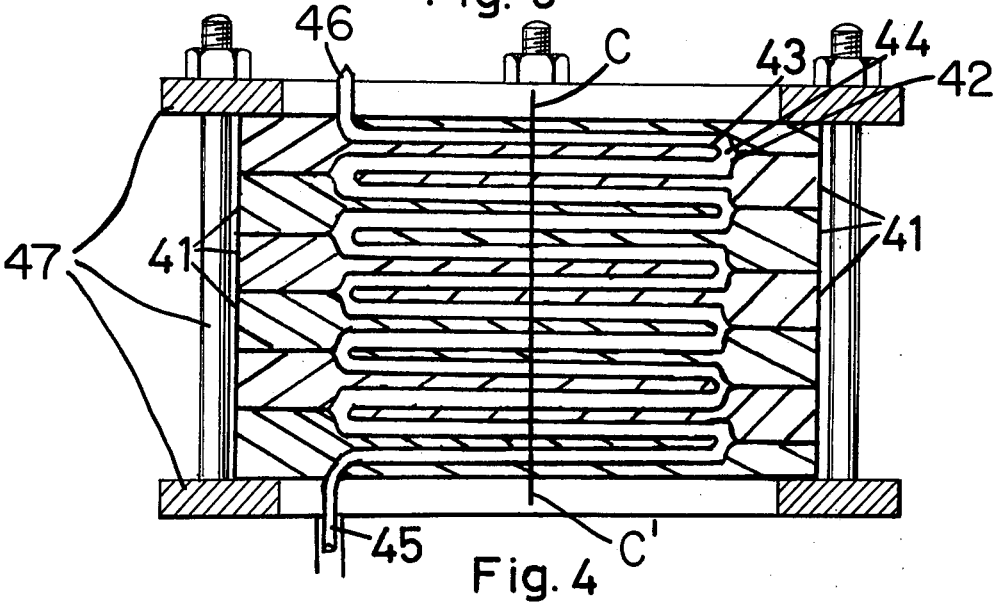
Figure 4A:
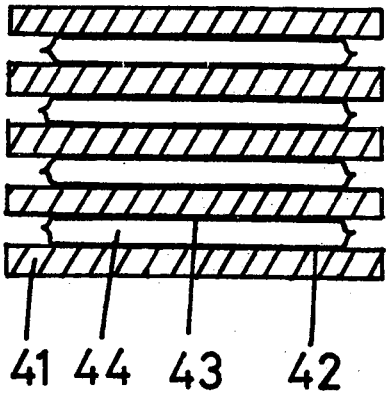
Figure 4B:
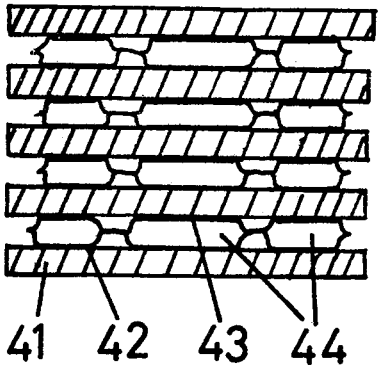

FIG. 4 shows a cross section through a conduit stack after inflation. Before inflation the stack has been clamped together by a conventional constraining frame 47. Strips 42 and 43 form a conduit having a continuous channel 44 running its entire length. Shaped tool pieces 41 are in position between each pass of the conduit. One end 45 of the conduit is connected to a source of fluid pressure (not shown) and the other end 46 is sealed. In an alternative arrangement, both ends 45 and 46 are connected to the source of fluid pressure. FIG. 4A shows a cross-section taken along the line CC′ when a single channel is used. FIG. 4B shows a similar cross-section of a multichannel tube.

Figure 5:
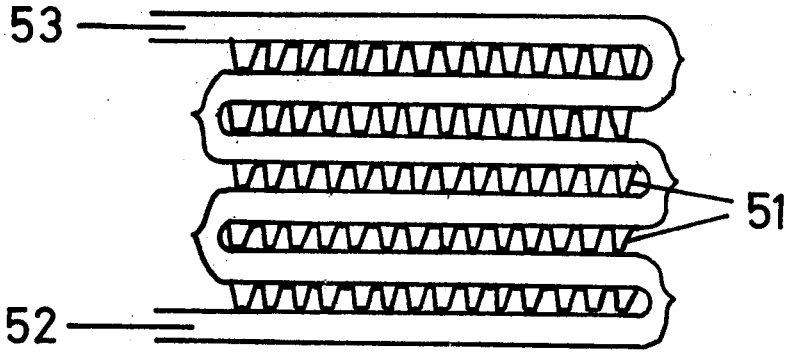

FIG. 5 shows a cross-section of a completed heat exchanger made in accordance with the present invention. Finning pieces 51 are positioned between each pass of the conduit and the ends 52 and 53 of the conduit are open to allow connection to the source (not shown) of the heat exchange liquid.

The following Example illustrates the invention. All parts are by weight.

EXAMPLE

Strips of 'Alcan 2S' aluminium foil in the annealed condition, 0.1 mm thick and 63.5 mm wide, were printed on one side with two stripes of adhesive 6.5 mm wide in the manner shown in FIG. 1*a*.

The adhesive, as applied, was a 16% solution in methanol of a 1:2 mixture of a phenolic resole having P:F ratio of 1:1.43 and a poly(vinyl butyral) of average molecular weight 41,000. The adhesive was dried in air at room temperature, leaving 22 g/sq. meter of adhesives in the strips.

Two such printed strips were placed face-to-face and folded in a displaced zigzag manner as shown in FIG. 2. The folded stack was placed in a press and subjected to a pressure of 2.1 MN/sq. meter and heated to 150° C. for 30 minutes to cure the adhesive. The stack was inflated with air at 70 kN/sq. meter to form a single passage heat exchanger core.

I claim:

1. A method of making a heat exchanger consisting of a conduit having a plurality of passes joined by integral return bends which consists essentially of, in sequence, (i) bending two strips of pliable material together in a zigzag manner to form a stack of parallel passes, the two strips being displaced laterally with respect to one another, (ii) bonding the two strips together along lines parallel to their longitudinal edges to form a flat, serpentine conduit, and (iii) inflating the conduit by applying internally a fluid under pressure.

2. Method according to claim 1, in which the strips are of metal.

3. Method according to claim 2, in which the strips are of aluminum or aluminium alloy.

4. Method according to claim 1, in which the strips are from 0.01 to 0.8 mm thick.

5. Method according to claim 1, in which the passes in the inflated conduit are parallel.

6. Method according to claim 1, in which the two strips are displaced laterally with respect to one another by being (a) folded together and then pulled apart in the direction at right angles to the height of the stack, or (b) folded separately to the same dimensions and fitted together so that the folds almost coincide, or (c) folded together in the required displaced configuration.

7. Method according to claim 1, in which the longitudinal edges of the strips are bonded by means of an adhesive.

8. Method according to claim 7, in which the adhesive is a thermosetting resin adhesive composition.

9. Method according to claim 2, in which the longitudinal edges of the metallic strips are bonded by welding, soldering, or brazing.

10. Methods according to claim 1, in which packing pieces, each twice the thickness of the strips, are inserted between each pair of passes in the return bends and pressure is applied to assist the bonding of the two strips together.

11. Method according to claim 1, in which the conduit has two or more separate channels.

12. Method according to claim 1, in which the conduit has two or more interconnecting channels.

13. Method according to claim 1, in which shaped tool pieces are inserted between layers of conduit, and the stack is constrained within a frame and fitted between tie bars before the conduit is inflated.

14. Method according to claim 1, in which finning pieces are inserted between passes of conduit before or after inflation.

15. Method according to any of claim 1, in which the heat exchanger is provided with a coating.

* * * * *